United States Patent [19]

Delsing et al.

[11] 4,280,931

[45] Jul. 28, 1981

[54] METHOD AND COMPOSITION FOR ELECTRICALLY RESISTIVE MATERIAL FOR TELEVISION CATHODE RAY TUBES

[75] Inventors: Dale Delsing, Skokie; Mark Fogelson, Wilmette, both of Ill.

[73] Assignee: Zenith Radio Corporation, Glenview, Ill.

[21] Appl. No.: 66,356

[22] Filed: Aug. 14, 1979

[51] Int. Cl.[3] ..... H01B 1/08; H01C 7/00

[52] U.S. Cl. ..... 252/518; 338/308

[58] Field of Search ..... 252/518

[56] References Cited

U.S. PATENT DOCUMENTS

| | | | |
|---|---|---|---|
| 2,617,742 | 11/1952 | Olson | 252/518 X |
| 3,044,901 | 7/1962 | Garnsworthy | 252/518 X |
| 3,287,284 | 11/1966 | Norman | 252/518 |
| 3,888,796 | 6/1975 | Nigol | 252/518 |
| 3,919,123 | 11/1975 | Kamigaito et al. | 252/518 |
| 4,091,144 | 5/1978 | Dresner et al. | 252/518 X |
| 4,101,803 | 7/1978 | Retsky et al. | 315/3 |
| 4,153,857 | 5/1979 | Delsing et al. | 313/481 |

FOREIGN PATENT DOCUMENTS

| | | | |
|---|---|---|---|
| 2749210 | 5/1977 | Fed. Rep. of Germany | 252/518 |
| 2749212 | 5/1978 | Fed. Rep. of Germany | 252/518 |

OTHER PUBLICATIONS

Schwartz et al., "Recent Developments in Arc Suppression for Pictures Tubes," IEEE Transactions on Consumer Electronics, vol. CE-25, Feb. 1979, pp. 82-90 .

*Primary Examiner*—Richard D. Lovering

*Attorney, Agent, or Firm*—Ralph E. Clarke, Jr.

[57] ABSTRACT

An improved electrically resistive arc-suppressive material is disclosed for use in a television cathode ray tube. The tube includes a funnel with a conductive coating on the inner surface thereof and a neck enclosing an electron gun having snubber springs extending from an anode electrode. The arc-suppressive material according to the invention is deposited in an area between the conductive coating and the gun and in contact with the snubber springs. The improved resistive material comprises tin oxide ($SnO_2$) doped with an antimony compound and calcined in a semi-sealed crucible for about two hours at a temperature in the range of 1306° C. to 1326° C., and blended with glass frit in a weight-percent ratio range of 45-55. The doping and the temperature range and duration are effective to inbue the material with a hardness resistant to plowing by the snubber springs, and electrical resistance value effective to suppress arcing.

15 Claims, No Drawings

METHOD AND COMPOSITION FOR ELECTRICALLY RESISTIVE MATERIAL FOR TELEVISION CATHODE RAY TUBES

BACKGROUND OF THE INVENTION AND PRIOR ART STATEMENT

This invention relates to the maufacture of television cathode ray tubes and is concerned specifically with electrically resistive materials for use in such tubes.

It is conventional in television cathode ray picture tubes to provide an electrically conductive coating comprised of colloidal graphite deposited on the inner surface of the funnel. The conductive coating commonly covers the entire inner surface of the funnel in an area extending to the junction of the funnel and the neck of the picture tube, as is well known in the art. A conductive coating is also located on the outside surface of the funnel. The glass of the cathode ray tube funnel serves as the dielectric medium of a capacitor formed by the difference in electrical potential established between the outer conductive coating and the inner conductive coating. The outer conductive coating is commonly at ground, or zero potential, and the inner conductive coating is at a relatively high potential, typically about 30 kilovolts. This high potential is applied to the forward electrode, or "anode electrode," of the electron gun located in the neck of the tube by a plurality of "snubber" springs extending from the gun to make contact with the inner conductive coating. By exerting a uniform outward pressure, the snubber springs also serve to center the forward section of the gun in the neck.

The high potential on the inner conductive coating and the propinquity of the electron gun parts has resulted in the problem of arcing primarily between the anode electrode and one or more of those electrodes of the electron gun adjacent to the anode electrode. The peak energy density of an arc typically may exceed several hundred million watts/$CM^2$, causing a literal explosion to take place within the tube. The effect is a loud report and oftentimes damage to the gun and ancillary television circuits, especially those with transistors. The severity of some arcs and the release of energy implicit therein can actually crack the neck of the tube.

To alleviate this tendency toward destructive arcing, there has been established the practice of introducing a highly resistive coating intermediate to the inner conductive coating and the area adjacent the anode electrode of the gun. The purpose is to control the surface potential of the glass neck and suppress current build-up during arcing. The result has been to reduce the incidence of arcing, or if arcing does occur, reduce the magnitude of the arcing currents to a tolerable level.

Several factors combine to impose stringent requirements on the composition and physical characteristics of the resistive coating. The material must provide very high resistance, of the order of several megohms. The composition must be homogeneous to prevent the existence of paths of low resistance, or voids of infinite resistance where there is a dearth of the resistive component. The material must be tolerant to heat experienced during manufacture and operation. Also, the material must be readily adherent to the glass of the type used in cathode ray tubes. Resistance to scratching by the snubber springs when the gun is inserted in the neck of the tube is another requisite as particles generated by such scratching can degrade tube quality.

Further, the material must be compatible with standard cathode ray tube processing procedures such as air bake during fritting and vacuum bake during the exhaust cycle, and subsequent high-voltage conditioning or "spot-knocking." Also, the material must be of low vapor pressure so it will not out-gas during the operating life of the tube. The ability to resist burn-out and consequent loss of electrical continuity at the points of contact with the snubber springs is yet another requirement.

We are aware of a method of compounding a resistive glass frit which comprises the method of dry mixing and blending an antimony oxide with tin oxide in the ratio of about 1 to 100, firing the mixture for two hours at a temperature of no more than 1300° C. in a quartz crucible having a loosely fitted, porous cover, and mixing the resulting powder with about an equal amount of glass frit. We found the resistive values of the frit compounded by this method to be unpredictable and nonreproducible.

A resistance coating consisting of an amorphous layer of an homogenous compound of a glass composition material, with at least one particulate material selected from a group basically consisting of cadmium oxide, indium, and copper oxide, is disclosed by German Pat. Nos. 27 49 210, and 27 49 212.

General background in the art, together with a description of a resistive coating, is presented in a paper by J. W. Schwartz and M. Fogelson entitled: "Recent Developments in Arc Suppression For Picture Tubes." (IEEE Transactions on Consumer Electronics, Volume CE-25, Feb. 1979).

A resistive formulation that can be used as a resistive coating is described and fully claimed in U.S. Pat. No. 4,153,857 to Delsing and Fogelson, assigned to the assignee of this invention. The resistive element is so widely and deeply cavitated and contorted at or below its nominal surface that the real surface of the element is shadowed and very greatly extended in area relative to the nominal surface of the element. The effect of this is that when the getter is flashed, the coating of conductive getter material deposited on the element is effectively dispersed and fragmented into isolated conductive islands. The result is to render tolerably insignificant the tendency of arc currents to travel over the surface of the element and thereby by-pass the body of the element. The surface topography is substantially that associated with the crystallization of camphor or the like.

In U.S. Pat. No. 4,101,803 to Retsky and Schwartz, assigned to the assignee of this invention, there is disclosed an anti-static coating deposited on the inner surface of the neck of a cathode ray tube around the beam egress from the electron gun and having a dynamic impedance value which is greater than that of associated arc-suppression resistors. The anti-static coating serves to drain off stray charges and to transmit the high voltage on the funnel inner conductive coating to the gun.

OBJECTS OF THE INVENTION

It is a general object of this invention to provide an improved electrically resistive material for use in television cathode ray tubes.

It is a less general object to provide an electrically resistive material that can be used as a resistive coating in cathode ray tubes.

It is a more specific object of this invention to provide an electrically resistive material that is homogeneous, tolerant to heat experienced during manufacture and operation, adherent to glass, and of hardness adequate to resist scratching by electron gun snubber springs.

It is another specific object of the invention to provide an electrically resistive material that is resistant to burn-out at snubber spring contact points, and resistant to high-voltage stress from spot-knocking and arcing.

DESCRIPTION OF THE PREFERRED EMBODIMENT

The method according to our invention comprises, essentially, the doping of tin oxide with an antimony compound to form an electrically resistive material. Further, the material is calcined in a semisealed crucible at a temperature of 1316° C. +10° for about two hours after which it is mixed with a glass frit in the weight-percent ratio range of 45 to 55.

Examples of specific electrically resistive materials according to the invention which have been successfully used in connection with the fabrication of television cathode ray tubes are set forth in the following.

EXAMPLE 1

A suitable resistive material according to the invention is compounded as follows. The amount is that which can be conveniently mixed in a two liter container. This amount can be scaled up as necessary to provide any quantity required for production.

(a) mix 1 gram of antimony trioxide ($Sb_2O_3$) with about 600 milliliters of deionized water and stir thoroughly to make a uniform suspension;

(b) mix the suspension with about 1,000 grams of tin oxide ($SnO_2$) to form a homogeneous paste;

(c) dry the paste at a temperature of about 110° C., and break up the resulting cake into a powder;

(d) transfer the powder to a semi-sealed alumina crucible;

(e) calcine in a temperature range of 1306° C. to 1326° C. for about 2 hours;

(f) cool the calcined material and mix in a quantity of glass frit in a weight-percent ratio range of about 45 to 55.

It will be noted that, in this example, the ratio of antimony trioxide to tin oxide is 1 to 1,000. The percentage of antimony and the calcining temperature cycle determines the resistance values of the material applied as a coating in cathode ray tubes according to the following table:

TABLE OF TYPICAL RESISTANCE VALUES BASED ON PERCENTAGE OF ANTIMONY

| Percentage of $Sb_2O_3$ (or antimony resinate) | Resistance Per Square, about - |
|---|---|
| 3 | $0.31 \times 10^6$ |
| 1 | $0.5 \times 10^6$ |
| 0.5 | $0.75 \times 10^6$ |
| 0.25 | $2.5 \times 10^6$ |
| 0.1 | $3.0 \times 10^7$ |
| 0.075 | $2.6 \times 10^9$ |

Conditions:

1. Resistance values are those of the material when deposited as a coating about two mils thick, and after conventional frit cycle bake and subsequent tube vacuum bake process.
2. Percentages are by weight.

The criticality of the closely controlled temperature cycle; that is, 1316° C. ±10° for about two hours, together with the amount of antimony present, determines the electrical and physical properties of the material according to the invention. In effect, the tin oxide is doped to become slightly electrically conductive by the addition of the proper amount of antimony to create an imperfect lattice in the crystalline structure. Calcining at too high a temperature reduces the resistance of the material to high-voltage burn-out, while calcining below the limit specified results in a coating too soft to tolerate scratching by the snubber springs.

The preferred temperature cycle is as follows: the temperature of an electric furnace containing the crucible is allowed to rise for about 3 hours at a steady rate to within the required temperature range of 1306° C. to 1326° C. The temperature is maintained constant for about 2 hours. The crucible is then allowed to cool slowly.

The term "semi-sealed" applied to the crucible connotes, in the context of this disclosure, an alumina crucible, for example, having an impervious cover ground to fit over the crucible opening. We believe that the use of a semi-sealed cover according to the invention prevents loss of the antimony component through evaporation, and ensures the uniformity of the calcined material. These two factors are instrumental in providing predictability and reproducibility.

The tin oxide may be of the type designated as Item No. 3975 supplied by J. T. Baker Chemical Co., Philipsburg, N.J., or equivalent. The antimony trioxide may be of the type designated Part No. 886 supplied by the same company or an equivalent. The glass frit may be that designated as Glass 8463 supplied by Corning Glass Works, Corning, N.Y., or an equivalent. The glass frit is preferably additionally ground to sub-micron particle size to facilitate blending and uniformity.

EXAMPLE 2

(a) mix a quantity of antimony resinate having an antimony content equivalent to 1.0 grams of antimony trioxide with a suitable thinner to form a dilution;

(b) mix the dilution with 1,000 grams of tin oxide ($SnO_2$) to form a homogeneous paste;

(c) evaporate the thinner and burn out the resinate by heating the paste at a temperature of about 425° C. for about 1 hour, and break up the resulting cake into a powder.

Continue with steps (d) through (f) described for preceding Example 1. As with Example 1, the calcining temperature must be held within the range of 1306° C. to 1326° C. for about 2 hours. The resin component is completely eliminated; it is primarily the residuum of antimony oxides that determines the resistance values of the material deposited as a coating, whether it is initially antimony trioxide, or an organo-metallic compound such as antimony resinate.

The antimony resinate may be that supplied by Englehardt Industries, Englewood Cliffs, N.J. under the designation Part No. 9258. An equivalent having the same properties may be substituted.

The resistive material compounded according to the inventive method exhibits the desired characteristics of stability and is unaffected by the normal CRT manufacturing processes, such as the alternate heating and cooling cycles, etc. Further, once applied, the resistive coating according to the invention is stable and unaffected by the operating environment of the tube. The material is easy to apply and is compatible with the glass of the cathode ray tube, ensuring permanent adherence following the conventional frit cycle bake.

By extensive research and testing we proved the necessity of (1) maintaining the temperature at 1316° C. ±10°; (2) maintaining proper amount of the dopant antimony oxide to achieve desired resistivity, as per foregoing Table of Typical Resistance Values, and (3), calcining in a crucible equipped with a non-porous, ground-to-fit cover defined in this disclosure as being "semi-sealed."

As noted, a necessary property, and one provided by the material according to the invention, is resistance to scratching by the snubber springs during insertion of the gun into the neck of the tube. The ability of a coating material to resist such scratching can be determined by means of a simple fixture, the devising of which is well within the purview of one skilled in the art. This fixture is one that provides means for drawing a typical snubber spring across the surface of the sample of the resistive coating deposited, for example, on a glass slide and hardened by baking. The recommended pressure is about 200 grams. The abraded surface is examined under a microscope of about 60 to 80 power. Scratch resistance is deemed adequate if the tip of the spring "writes" on the coating, yet will not "plow" the surface and generate particulate material visible under the microscope.

It will be recognized that changes may be made in the aforedescribed compounds and proportions thereof without departing from the true spirit and scope of the invention herein involved, and it is intended that the subject matter in the above depiction shall be interpreted as illustrative and not in a limiting sense.

We claim:

1. For use in a television cathode ray tube including a funnel with a conductive coating on the inner surface thereof and a neck enclosing an electron gun having snubber springs extending from an anode electrode, an improved electrically resistive arc-suppressive material to be deposited in an area between said conductive coating and said gun and in contact with said snubber springs, said improved resistive material comprising tin oxide ($SnO_2$) doped with an antimony compound and calcined in a semi-sealed crucible for about two hours at a temperature in the range of 1306° C. to 1326° C., and blended with glass frit in a weight-percent ratio range of 45–55, said doping, and said temperature range and duration being effective to imbue said material, with a hardness resistant to plowing by said snubber springs and an electrical resistance value effective to suppress said arcing.

2. The material defined by claim 1 wherein the dopant consists of antimony trioxide in a weight-percent ratio range with tin oxide of 0.075–3.0 to 100.

3. The material defined by claim 1 wherein the dopant consists of antimony resinate having an antimony content equivalent to 1.0 gram of antimony trioxide.

4. For use in the manufacture of a television cathode ray tube including a funnel with a conductive coating on the inner surface thereof and a neck enclosing an electron gun having snubber springs extending from an anode electrode, a method for compounding an improved electrically resistive material comprising the doping of tin oxide ($SnO_2$) with an antimony compound, calcining the resultant in a semi-sealed crucible at a temperature in the range of 1306° C. to 1326° C. for about two hours, and blending with glass frit in the weight-percent ratio range of 45–55, said doping, and said temperature range and duration being effective to imbue said material with a hardness resistant to plowing by said snubber springs, and an electrical resistance value effective to suppress said arcing.

5. The method defined by claim 4 wherein the dopant consists of antimony trioxide in a weight-percent ratio range with tin oxide of 0.075–3.0 to 100.

6. The method defined by claim 4 wherein the dopant consists of antimony resinate having an antimony content equivalent to 1.0 gram of antimony trioxide.

7. A method for compounding a resistive material for use in television cathode ray tubes comprising:

wet-mixing antimony trioxide and tin oxide ($SnO_2$) in a weight-percent ratio range of 0.075–3.0 to 100;

drying the mixture and calcining it in a semi-sealed crucible at a temperature within the range of 1306° C. to 1326° C. for about 2 hours;

blending the cooled calcined mixture with glass frit in a weight-percent ratio range of 45 to 55.

8. The method according to claim 7 wherein the resistive material so compounded has a resistive value when deposited in the range of $0.31\times10^6$ to $2.6\times10^9$ ohms per square.

9. The method according to claim 7 wherein said glass frit is ground to a sub-micron particle size.

10. A method for compounding a resistive material for use in a television cathode ray tube comprising:

mixing 1 gram of antimony trioxide ($Sb_2O_3$) with about 600 milliliters of deionized water and stirring thoroughly to make a uniform suspension;

mixing the suspension with 1,000 grams of tin oxide ($SnO_2$) to form a homogeneous paste;

drying the paste at a temperature of about 110° C.; breaking up the resulting cake into a powder;

calcining the powder at a temperature in the range of 1306° C. to 1326° C. for about two hours, using a semi-sealed crucible;

mixing the cooled calcined material with a quantity of glass frit in a weight-percent ratio range of 45 to 55.

11. The method according to claim 10 wherein said resistive coating so compounded has a resistance value of about $3\times10^7$ ohms per square.

12. The method according to claim 10 wherein said glass frit is ground to a sub-micron particle size.

13. A method for compounding a resistive material for use in television cathode ray picture tubes comprising:

mixing a quantity of antimony resinate having an antimony content equivalent to 1.0 grams of antimony trioxide with a suitable thinner to form a dilution;

mixing the dilution with about 1,000 grams of tin oxide ($SnO_2$) to form a homogeneous paste;

evaporating the thinner and burning out the resinate by heating the mixture at a temperature of about 425° for about 1 hour;

breaking up the resulting cake into a powder;

calcining the powder at a temperature within the range of 1306° C. to 1326° C. for about 2 hours, using a semi-sealed crucible;

mixing the cooled calcined material with a quantity of glass frit in the weight-percent ratio range of 45 to 55.

14. The method according to claim 13 wherein the resistive coating so compounded has a resistance value when deposited of about $3\times10^7$ ohms per square.

15. The method according to claim 13 wherein said glass frit is ground to a sub-micron particle size.

* * * * *